US011724379B2

(12) United States Patent
Comarmond

(10) Patent No.: US 11,724,379 B2
(45) Date of Patent: Aug. 15, 2023

(54) ROTARY-PERCUSSIVE HYDRAULIC PERFORATOR PROVIDED WITH A CONTROL CHAMBER PERMANENTLY CONNECTED TO A LOW-PRESSURE ACCUMULATOR

(71) Applicant: MONTABERT, Saint-Priest (FR)

(72) Inventor: Jean-Sylvain Comarmond, Vourles (FR)

(73) Assignee: MONTABERT, Saint-Priest (FR)

( * ) Notice: Subject to any disclaimer, the term of this patent is extended or adjusted under 35 U.S.C. 154(b) by 433 days.

(21) Appl. No.: 16/969,806

(22) PCT Filed: Jan. 16, 2019

(86) PCT No.: PCT/FR2019/050089

§ 371 (c)(1),
(2) Date: Aug. 13, 2020

(87) PCT Pub. No.: WO2019/158834

PCT Pub. Date: Aug. 22, 2019

(65) Prior Publication Data

US 2021/0001462 A1 Jan. 7, 2021

(30) Foreign Application Priority Data

Feb. 14, 2018 (FR) ..... 18/51249

(51) Int. Cl.
*B25D 9/14* (2006.01)
*B25D 17/06* (2006.01)
*B25D 9/26* (2006.01)

(52) U.S. Cl.
CPC ..... *B25D 9/145* (2013.01); *B25D 9/26* (2013.01); *B25D 17/06* (2013.01); *B25D 2209/002* (2013.01); *B25D 2217/0023* (2013.01)

(58) Field of Classification Search
CPC ..... B25D 17/06; B25D 9/14
See application file for complete search history.

(56) References Cited

U.S. PATENT DOCUMENTS 5,479,996 A 1/1996 Joensson et al.

FOREIGN PATENT DOCUMENTS

EP 0080446 A2 6/1983
WO 2010082871 A1 7/2010

OTHER PUBLICATIONS

English Translation to International Search Report for Application No. PCT/FR2019/050089.
International Search Report for Application No. PCT/FR2019/050089.
Written Opinion for Application No. PCT/FR2019/050089.

*Primary Examiner* — Praachi M Pathak
(74) *Attorney, Agent, or Firm* — Cantor Colburn LLP

(57) ABSTRACT

The rotary percussive hydraulic perforator comprises a body; a fitting; a striking piston configured to strike the fitting; a stop piston including a front face facing the fitting and a rear face situated opposite to a rear wall of a cavity receiving the piston stop; and a main hydraulic supply circuit including a high pressure fluid supply conduit and a low pressure fluid return conduit. The body and the stop piston delimit a first control chamber permanently connected to the high pressure fluid supply conduit and configured to bias the stop piston forwards, and a second control chamber configured to bias the stop piston forwards and permanently connected to a low pressure accumulator connected to the low pressure fluid return conduit.

20 Claims, 2 Drawing Sheets

ROTARY-PERCUSSIVE HYDRAULIC PERFORATOR PROVIDED WITH A CONTROL CHAMBER PERMANENTLY CONNECTED TO A LOW-PRESSURE ACCUMULATOR

CROSS REFERENCE TO RELATED APPLICATIONS

This application is a National Stage of PCT Application No. PCT/FR2019/050089 filed on Jan. 16, 2019, which claims priority to French Patent Application No. 18/51249 filed on Feb. 14, 2018, the contents each of which are incorporated herein by reference thereto.

TECHNICAL FIELD

The present invention relates to a rotary percussive hydraulic perforator more especially used on a drilling unit.

BACKGROUND

A drilling unit comprises, in a known manner, a rotary percussive hydraulic perforator slidably mounted on a slide and driving one or more drilling bars, the last of these drilling bars carrying a tool called a bit which in contact with the rock. The purpose of such a perforator is generally to drill more or less deep holes in order to be able to place explosive charges therein. The perforator is therefore the main element of a drilling unit which, on the one hand, gives the bit the rotation and the percussion via the drilling bars so as to penetrate the rock, and on the other hand, provides an injection fluid so as to extract the debris from the drilled hole.

A rotary percussive hydraulic perforator more particularly comprises on the one hand a striking system which is driven by one or more hydraulic fluid flows coming from a main hydraulic supply circuit and which comprises a striking piston configured to strike, at each operating cycle of the perforator, a fitting coupled to the drilling bars, and on the other hand a rotation system provided with a hydraulic rotary motor and configured to rotate the fitting and the drilling bars.

The bearing force of the rotary percussive hydraulic perforator on the drilling bars, and therefore of the bit on the rock, is generated by the slide, thanks to a cable or a drive chain moved by a hydraulic cylinder or a hydraulic motor. More specifically, the bearing force is transmitted from the body of the perforator to the fitting via a stop element incorporated in the body of the perforator. This stop element can be constituted, for powerful perforators, of a stop piston, whose at least one surface is hydraulically supplied so as to ensure transmission of the bearing force by means of a fluid.

The stability and the performance in penetration speed of a rotary percussive hydraulic perforator, when it is operating, depend in particular on the way in which this stop piston is arranged and hydraulically supplied.

Document WO2010/082871 discloses a rotary percussive hydraulic perforator in which, in operating conditions of the striking system, the stop piston is positioned in an equilibrium position, in accordance with a desired striking stroke of the striking piston, via a hydraulic control chamber delimited by the striking piston and the body of the perforator and permanently connected to a high pressure fluid supply conduit, the hydraulic control chamber being configured on the one hand to bias the stop piston forwards and on the other hand to be connected to a low pressure fluid return conduit when the rear face of the stop piston is located at a predetermined distance from the rear wall of the cavity receiving the stop piston.

The configuration of the stop piston and of the body described in document WO2010/082871 makes it possible to ensure an approximately stable positioning of the stop piston during the operation of the striking system.

However, the vibrations and reactions of the rock to the repeated shocks of the bit make the bearing force of the tool of the drilling bar unstable on the rock, particularly during movements of the tool due to the penetration of the drilling bar in the ground and to various vibrations of the body of the perforator. However, such instability of the bearing force of the bit on the rock affects the positioning of the fitting relative to the striking piston and therefore the performance of the hydraulic perforator.

BRIEF SUMMARY

The present invention aims to remedy all or part of these drawbacks.

The technical problem underlying the invention therefore consists in providing a hydraulic perforator which is simple and economical in structure, while having improved performance.

To this end, the present invention concerns a rotary percussive hydraulic perforator comprising:

- a body,
- a fitting intended to be coupled to at least one drilling bar equipped with a tool,
- a striking piston slidably mounted inside the body along a striking axis and configured to strike the fitting,
- a stop piston which is tubular and which is slidably mounted in a body cavity along an axis of displacement substantially parallel to the striking axis, the stop piston including a front face facing the fitting and intended to position the fitting in a predetermined equilibrium position with respect to the striking piston, and a rear face opposite to the front face and situated opposite to a rear wall of the cavity, and
- a main hydraulic supply circuit configured to control an alternating sliding of the striking piston along the striking axis and to control a sliding of the stop piston along the displacement axis, the main hydraulic supply circuit including a high pressure fluid supply conduit and a low pressure fluid return conduit, the body and the stop piston delimiting at least partially a first control chamber permanently connected to the high pressure fluid supply conduit and configured to bias the stop piston forwards, that is to say towards the fitting and therefore opposite to the rear wall of the cavity, the rotary percussive hydraulic perforator further comprising a connecting channel configured to fluidly connect the first control chamber to the low pressure fluid return conduit when the rear face of the stop piston is located at a distance from the rear wall of the cavity which is greater than a predetermined value, characterized in that the main hydraulic supply circuit further includes a low pressure accumulator connected to the low pressure fluid return conduit, and in that the body and the stop piston further delimit at least partially a second control chamber permanently connected to the low pressure accumulator and configured to bias the stop piston forwards.

Such a configuration of the second control chamber makes it possible, owing to the permanent connection of the latter with the low pressure accumulator, to ensure a high-speed displacement of the stop piston forwards when the rock yields under the impact of the striking piston and the fitting is suddenly free to move forwards. This allows quickly restoring a normal bearing force of the tool of the drilling bar on the rock, despite the movements due to the penetration of the drilling bar into the ground and the various vibrations of the body of the perforator.

Furthermore, the particular configuration of the first control chamber and the connecting channel makes it possible to hydraulically position the stop piston in an approximately stable equilibrium position corresponding to an optimal striking stroke of the striking piston.

Thus, the particular configuration of the rotary percussive hydraulic perforator according to the present invention gives it improved performance relative to the rotary percussive hydraulic perforators of the prior art.

The hydraulic perforator may further have one or more of the following characteristics, taken alone or in combination.

According to an embodiment of the invention, the low pressure accumulator is a membrane accumulator, such as a hydropneumatic accumulator. The membrane accumulator advantageously includes a flexible membrane whose first face is subjected to the pressure of a volume of compressible gas contained in the membrane accumulator and whose second face is subjected to the pressure of the low pressure fluid coming from the low pressure fluid return conduit.

According to an embodiment of the invention, the second control chamber is connected to the low pressure accumulator by a return channel.

According to an embodiment of the invention, the stop piston includes a first annular control surface extending transversely to the displacement axis and at least partially delimiting the first control chamber and a second annular control surface extending transversely to the displacement axis and at least partially delimiting the second control chamber, the second annular control surface having a surface area greater than the surface area of the first annular control surface.

According to an embodiment of the invention, the first control chamber has a cross section smaller than the cross section of the second control chamber.

According to an embodiment of the invention, each of the first and second annular control surfaces extends substantially perpendicular to the displacement axis.

According to an embodiment of the invention, the first annular control surface is closer to the front face of the stop piston than the second annular control surface.

According to an embodiment of the invention, the body and the stop piston at least partially delimits a third control chamber permanently connected to the low pressure fluid return conduit, the third control chamber being antagonistic the first and second control chambers.

According to an embodiment of the invention, the third control chamber is permanently connected to the low pressure accumulator.

According to an embodiment of the invention, the third control chamber is configured to bias the stop piston backwards, that is to say towards the rear wall of the cavity and therefore opposite to the fitting.

According to an embodiment of the invention, the third control chamber is connected to the low pressure fluid return conduit by a fluid communication channel provided with a calibrated orifice.

According to an embodiment of the invention, the return channel includes a spray nozzle comprising the calibrated orifice.

According to an embodiment of the invention, the third control chamber has a cross section smaller than the cross section of the second control chamber.

According to an embodiment of the invention, the stop piston includes the connecting channel, and the connecting channel includes a first end portion opening into the third control chamber and a second end portion opposite to the first end portion and opening into an external surface of the stop piston, the second end portion being able to be fluidly connected to the first control chamber when the rear face of the stop piston is located at a distance from the rear wall of the cavity greater than the predetermined value.

According to an embodiment of the invention, the stop piston includes the connecting channel.

According to an embodiment of the invention, the connecting channel includes a first end portion opening into the first control chamber and a second end portion opposite to the first end portion and opening into an external surface of the stop piston, the second end portion of the connecting channel being able to be fluidly connected to the low pressure fluid return conduit when the rear face of the stop piston is located at a distance from the rear wall of the upper cavity at the predetermined value.

According to an embodiment of the invention, the body includes an annular groove opening into the cavity and permanently connected to the low pressure fluid return conduit, the second end portion of the connecting channel being able to be fluidly connected to the annular groove when the rear face of the stop piston is located at a distance from the rear wall of the cavity greater than the predetermined value.

According to an embodiment of the invention, the annular groove is connected to the low pressure accumulator.

According to an embodiment of the invention, the rotary percussive hydraulic perforator includes a supply channel connecting the first control chamber to the high pressure fluid supply conduit.

According to an embodiment of the invention, the supply channel is provided with a calibrated orifice.

According to an embodiment of the invention, the supply channel includes a spray nozzle comprising the calibrated orifice.

According to an embodiment of the invention, the stop piston is slidably mounted around the striking piston.

According to an embodiment of the invention, the main hydraulic supply circuit includes a high pressure accumulator connected to the high pressure fluid supply conduit.

According to an embodiment of the invention, the high pressure accumulator is a membrane accumulator, such as a hydropneumatic accumulator. The membrane accumulator forming the high pressure accumulator advantageously includes a flexible membrane whose first face is subjected to the pressure of a volume of compressible gas contained in the membrane accumulator and whose second face is subjected to the pressure of the high pressure fluid coming from the high pressure fluid supply conduit.

According to an embodiment of the invention, the rotary percussive hydraulic perforator further includes an annular stop member disposed between the fitting and the front face of the stop piston.

According to an embodiment of the invention, the annular stop member is a stop ring.

According to an embodiment of the invention, the rotary percussive hydraulic perforator includes a thrust bearing disposed between the rear face of the stop piston and the rear wall of the cavity. The thrust bearing can for example be a roller thrust bearing.

According to an embodiment of the invention, the stop piston includes an annular bearing surface configured to abut against an annular stop surface of the body.

According to an embodiment of the invention, the annular bearing surface is configured to abut against the annular stop surface of the body when the rear face of the stop piston is located at a predetermined distance from the rear wall of the cavity, the predetermined distance being greater than the predetermined value.

According to an embodiment of the invention, the annular bearing surface is inclined relative to the displacement axis.

According to an embodiment of the invention, the stop piston includes an annular flange including the annular bearing surface.

According to an embodiment of the invention, the annular flange at least partially delimits the third control chamber.

According to an embodiment of the invention, the annular flange includes the first annular control surface.

According to an embodiment of the invention, the body includes a piston cylinder in which the striking piston is alternately slidably mounted, the cavity being formed in the body coaxially with the piston cylinder.

According to an embodiment of the invention, the fitting extends longitudinally along the striking axis.

According to an embodiment of the invention, the fitting includes a first end portion facing the striking piston and provided with an end face against which the striking piston is intended to strike, and a second end portion, opposite to the first end portion, intended to be coupled to the at least one drilling bar.

According to an embodiment of the invention, the high pressure fluid supply conduit is a high pressure incompressible fluid supply conduit, and the low pressure fluid return conduit is a low pressure incompressible fluid return conduit.

BRIEF DESCRIPTION OF THE DRAWINGS

In any case, the invention will be clearly understood with the aid of the description which follows, with reference to the appended schematic drawings representing, by way of non-limiting examples, several embodiments of this hydraulic perforator.

DETAILED DESCRIPTION

Figure 1:
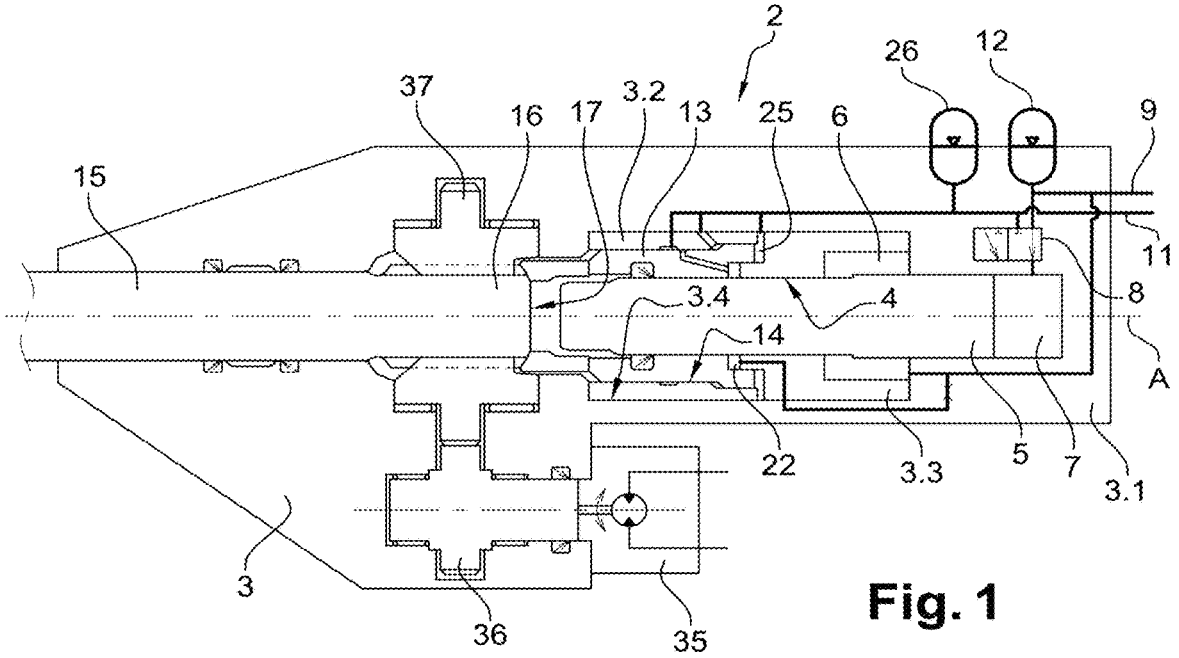
FIG. 1 is a longitudinal sectional view of a rotary percussive hydraulic perforator according to a first embodiment of the invention.
Figure 2:
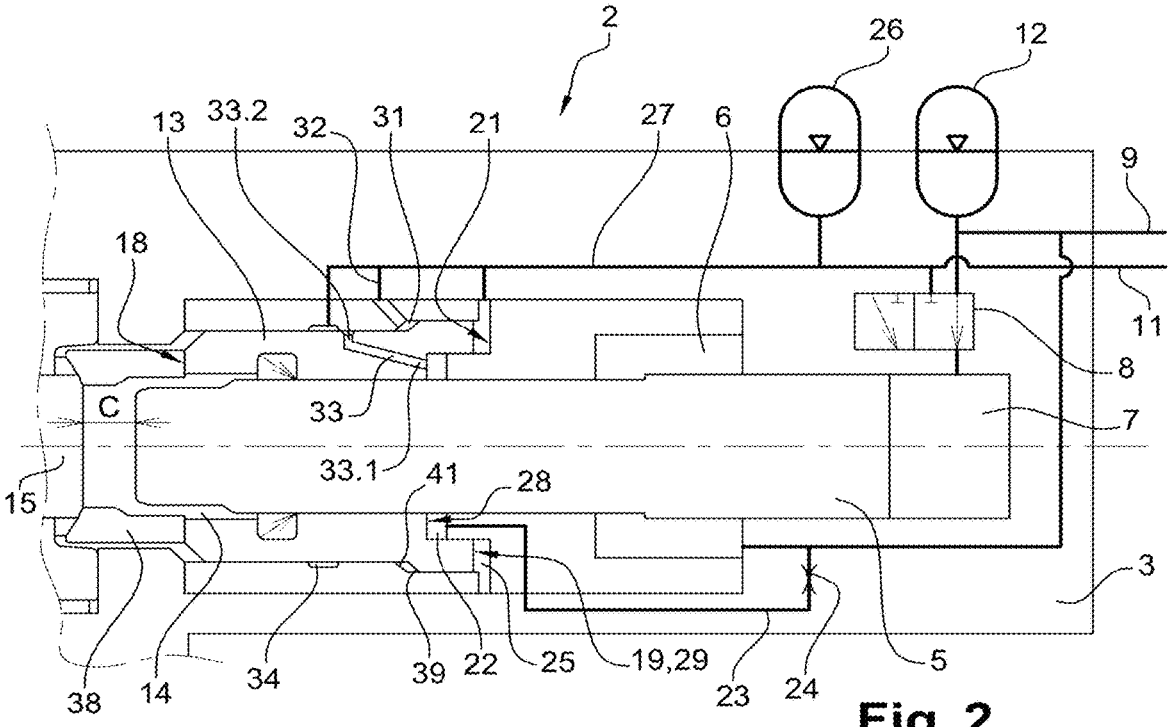
FIG. 2 is a longitudinal sectional view, on an enlarged scale, of a detail of FIG. 1.

FIGS. 1 and 2 represent a first embodiment of a rotary percussive hydraulic perforator 2 which is intended for perforating blast holes, and which is provided in particular with a striking system and a rotation system.

The rotary percussive hydraulic perforator 2 more particularly includes a body 3 including a piston cylinder 4. According to the embodiment represented in FIGS. 1 and 2, the body 1 includes a main body 3.1 partially delimiting the piston cylinder 4, as well as a front liner 3.2 and a rear liner 3.3 mounted in force in a bore 3.4 delimited by the main body 3.1.

The striking system of the rotary percussive hydraulic perforator 2 includes a striking piston 5 slidably mounted alternately in the piston cylinder 4 along a striking axis A. As shown more particularly in FIG. 2, the striking piston 5 and the piston cylinder 4 delimit a primary control chamber 6 which is annular, and a secondary control chamber 7 which has a section larger than that of the primary control chamber 6 and which is antagonistic to the primary control chamber 6.

The striking system of the rotary percussive hydraulic perforator 2 further comprises a control distributor 8 arranged to control an alternating movement of the striking piston 5 inside the piston cylinder 4 alternately according to a striking stroke and a return stroke. The control distributor 8 is configured to put the secondary control chamber 7, alternately in relation with a high pressure fluid supply conduit 9, such as a high pressure incompressible fluid supply conduit, during the striking stroke of the striking piston 5, and with a low pressure fluid return conduit 11, such as a low pressure incompressible fluid return conduit, during the return stroke of the striking piston 5. The high pressure fluid supply conduit 9 and the low pressure fluid return conduit 11 belong to a main hydraulic supply circuit which is provided with the striking system. The main hydraulic supply circuit can advantageously include a high pressure accumulator 12 connected to the high pressure fluid supply conduit 9.

The control distributor 8 is more particularly movably mounted in a bore formed in the body 3 between a first position (see FIG. 2) in which the control distributor 8 is configured to put the secondary control chamber 7 in relation with the high pressure fluid supply conduit 9 and a second position in which the control conduit 8 is configured to put the secondary control chamber 7 in relation with the low pressure fluid return conduit 11.

The primary control chamber 6 is advantageously permanently supplied with high pressure fluid by a supply channel (not represented in the figures), so that each position of the control distributor 8 causes the striking stroke of the striking piston 5, then the return stroke of the striking piston 5.

The striking system of the rotary percussive hydraulic perforator 2 also comprises a stop piston 13 which is tubular and which is slidably mounted in a cavity 14 of the body 3 along an axis of displacement parallel to the striking axis A and preferably coincident with the striking axis A. According to the embodiment represented in FIGS. 1 and 2, the stop piston 13 is slidably mounted around the striking piston 5, and the cavity 14 is formed in the body 3 coaxially with the piston cylinder 4.

The rotary percussive hydraulic perforator 2 further includes a fitting 15 intended to be coupled, in a known manner, to at least one drilling bar (not represented in the figures) equipped with a tool. The fitting 15 extends longitudinally along the striking axis A, and includes a first end portion 16 facing the striking piston 5 and provided with an end face 17 against which the striking piston 5 is intended to strike during each operating cycle of the rotary percussive hydraulic perforator 2, and a second end portion (not represented in the figures), opposite to the first end portion 16, intended to be coupled to at least one drilling bar.

As shown more particularly in FIG. 2, the stop piston 13 including a front face 18 facing the fitting 15 and intended to position the fitting 15 in a predetermined equilibrium position relative to the striking piston 5, and a rear face 19 opposite to the front face 18 and situated opposite to a rear wall 21 of the cavity 14.

The body 3 and the stop piston 13 delimit, with the striking piston 5, a first control chamber 22 permanently connected to the high pressure fluid supply conduit 9 and configured to bias the stop piston 13 forwards, that is to say towards the fitting 15 and therefore opposite to the rear wall 21 of the cavity 14. The rotary percussive hydraulic perforator 2 advantageously includes a supply channel 23 connecting the first chamber control 22 to the high pressure fluid supply conduit 9. According to the first embodiment represented in FIGS. 1 and 2, the supply channel 23 is provided with a calibrated orifice 24, which can for example be provided on a spray nozzle incorporated in the supply channel 23.

The body 3 and the stop piston 13 delimit, with the striking piston 5, also a second control chamber 25 connected to a low pressure accumulator 26 which belongs to the main hydraulic supply circuit of the striking system and which is connected to the low pressure fluid return conduit 11. The second control chamber 25 is, like the first control chamber 22, also configured to bias the stop piston 13 forwards. Advantageously, the rotary percussive hydraulic perforator 2 comprises a return channel 27 connecting the second control chamber 25 to the low pressure accumulator 26.

According to the embodiment represented in FIGS. 1 and 2, the stop piston 13 includes a first annular control surface 28, also called first annular active surface, extending perpendicular to the axis of displacement and partially delimiting the first control chamber 22, and a second annular control surface 29, also called second annular active surface, extending perpendicular to the axis of displacement and partially delimiting the second control chamber 25. The second annular control surface 29 has advantageously a surface area greater than the surface area of the first annular control surface 28. In other words, the second control chamber 25 advantageously has a cross section greater than the cross section of the first control chamber 22.

The body 3 and the stop piston 15 also delimit a third control chamber 31 permanently connected to the low pressure fluid return conduit 11, by means of a fluid communication channel 32 opening into the third control chamber 31 and the return channel 27 which connects the fluid communication channel 32 to the low pressure fluid return conduit 11. The third control chamber 31 is antagonistic to the first and second control chambers 22, 25, and is thus configured to bias the stop piston 13 backwards.

Advantageously, the second control chamber 25 is dimensioned to have an active surface on the stop piston 13 much greater than the active surface of the third control chamber 31. The second and third control chambers 25, 31 being connected to the return channel 27 and to the low pressure accumulator 26, the calculation of the difference of the two active surfaces of the second and third control chambers 25, 31 gives a resulting active surface pushing the stop piston 13 forwards and subjected to the pressure of the low pressure accumulator 26.

The rotary percussive hydraulic perforator 2 further comprises a connection channel 33 configured to fluidly connect the first control chamber 22 to the low pressure fluid return conduit 11 when the rear face 19 of the stop piston 13 is located at a distance of the rear wall 21 of the cavity 14 which is greater than a predetermined value. According to the first embodiment represented in FIGS. 1 and 2, the stop piston 13 includes the connecting channel 33, and the connecting channel 33 includes a first end portion 33.1 opening into the first control chamber 22 and a second end portion 33.2 opposite to the first end portion 33.1 and opening into an external surface of the stop piston 13. Advantageously, the second end portion 33.2 of the connecting channel 33 is able to be fluidly connected to an annular groove 34, which opens into the cavity 14 and which is permanently connected to the low pressure fluid return conduit 11, when the rear face 19 of the stop piston 13 is located at a distance from the rear wall 21 of the cavity 14 which is greater than the predetermined value.

When the striking system of the rotary percussive hydraulic perforator 2 is supplied, the pressure established in the first control chamber 22, thanks to the oil flow which has flowed through the calibrated orifice 24, bias the stop piston 13 forwards up to a position such that the connecting channel 33 opens into the annular groove 34 permanently connected to the low pressure fluid return conduit 11. At this time, the stop piston 13, which is subjected, by the rock, to a force reactive to the pushing force exerted by the rotary percussive hydraulic perforator 2, stops moving forward, and finds a position of equilibrium on the edge of the outlet of the connecting channel 33 in the annular groove 34. By construction, this equilibrium position makes it possible to locate the fitting 15 at a distance from the striking piston 5 which corresponds to a striking stroke C provided for the striking piston 5. It should be noted that the calibrated orifice 24 is advantageously of a very small dimension relative to the connecting channel 33 and to the return channel 27 so that the pressure which is established in the first control chamber 22 drops very quickly when the connecting channel 33 opens in the annular groove 34. In addition, the flow rate which passes through the calibrated orifice 24 should preferably remain low since it is taken from the high pressure fluid supply conduit 9.

As described above, the flow of fluid supplying the first control chamber 22 is low, and therefore, the speed of displacement of the stop piston 13, resulting from this fluid flow, is also low. Meanwhile, the second control chamber 25 is freely supplied by the low pressure accumulator 26, and will make it possible to push the stop piston 13 at high speed, for example when the rock gives way under the impact of the striking piston 5 and that the fitting 15 is suddenly free to move forwards. This makes it possible to quickly restore a normal bearing force of the tool of the drilling bar on the rock, despite the movements due to the penetration of the drilling bar into the ground and the various vibrations of the body 3 of the perforator, while ensuring, thanks to the first control chamber 22, an average position of the stop piston 13 which respects the provided striking stroke C of the striking piston 5.

The rotary percussive hydraulic perforator 2 also comprises a rotation system including a hydraulic motor 35 driving a drive pinion 36 and a receiving pinion 37, so as to ensure a rotation movement of the fitting 15. The hydraulic motor 35 is advantageously hydraulically supplied by an outer hydraulic supply circuit.

When the rotary percussive hydraulic perforator 2 is in operation, the fitting 15 is rotated thanks to the hydraulic motor 35, and the fitting 15 receives on its end face 17 the cyclic shocks of the striking piston 5, ensured by the striking system supplied by the main hydraulic supply circuit. At the same time, the carrier on which is mounted the rotary percussive hydraulic perforator 2 applies a pushing force on the drilling bar, via the body 3 of the rotary percussive hydraulic perforator 2 and the fitting 15. Inside the perforator, between the body 3 and the fitting 15, this force is transmitted by means of the stop piston 13 and of a stop member 38, such as a stop ring, disposed between the fitting 15 and the front face 18 of the stop piston 13. The positioning of the stop piston 13 is thus purely hydraulic and is arranged so that the striking stroke C of the striking piston 5 is respected.

The stop piston 13 further includes an annular bearing surface 39 configured to abut against an annular stop surface 41 of the body 3, so as to limit the displacement stroke of the stop piston 13 forwards, that is to say towards the fitting 15. Advantageously, the annular bearing surface 39 is configured to abut against the annular stop surface 41 of the body 3 when the rear face 19 of the stop piston 13 is located at a predetermined distance from the rear wall 21 of the cavity 14, the predetermined distance being greater than the predetermined value. According to the first embodiment of the invention, the annular bearing surface 39 is inclined relative to the axis of displacement, and partially delimits the third control chamber 31.

Figure 3:
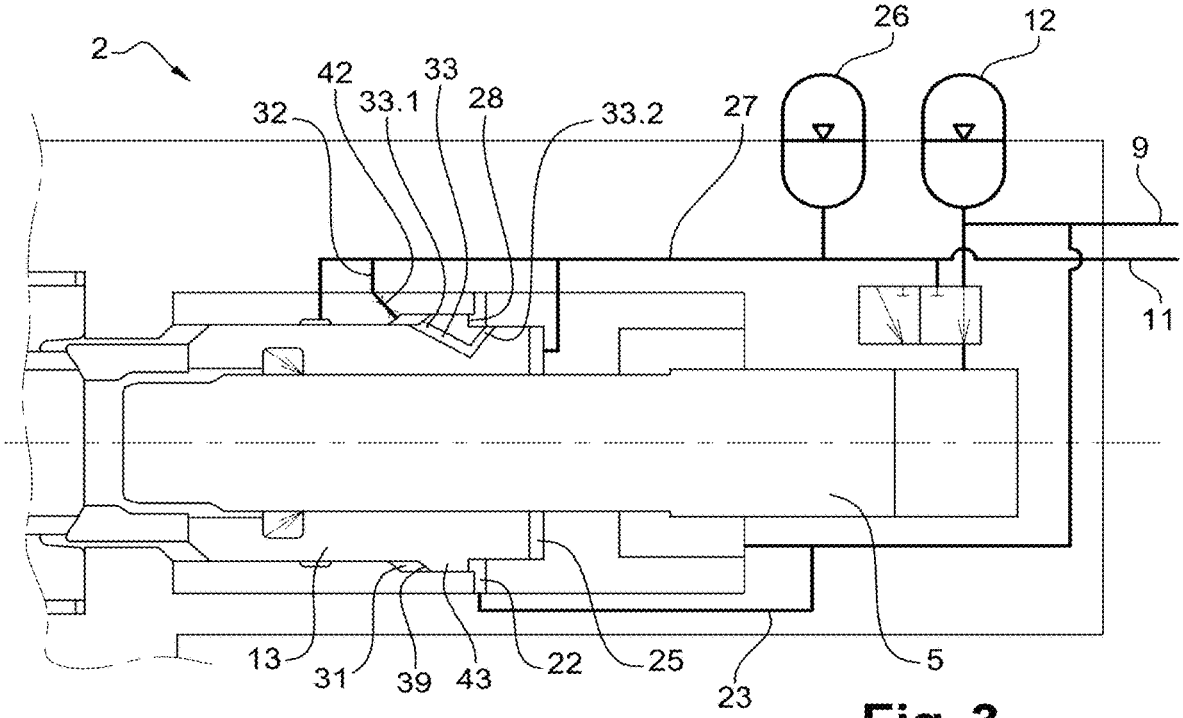
FIG. 3 is a longitudinal sectional view of a rotary percussive hydraulic perforator according to a second embodiment of the invention.

FIG. 3 represents a second embodiment of the rotary percussive hydraulic perforator 2 which differs from the first embodiment essentially in that the fluid communication channel 32 is provided with a calibrated orifice 42, which can for example be provided on a spray nozzle incorporated to the fluid communication channel 32, and in that the first end portion 33.1 of the connecting channel 33 opens into the third control chamber 31 and the second end portion 33.2 of the connecting channel 33 opens into an external surface of the stop piston 13, the second end portion 33.2 of the connecting channel 33 being able to be fluidly connected to the first control chamber 22 when the rear face 19 of the stop piston 13 is located at a distance from the rear wall 21 of the cavity 14 which is greater than the predetermined value.

When the rotary percussive hydraulic perforator 2 according to the second embodiment of the invention is in operation, the first control chamber 22 is subjected to high pressure, the stop piston 13 is displaced forwards until that the second end portion 33.2 of the connecting channel 33 opens in the first control chamber 22. The oil under high pressure then flows into the third control chamber 31 whose connection with the return channel 27 is throttled by the calibrated orifice 42. The first and third control chambers 22, 31 then take fairly close pressures, which reduces or cancels the forward thrust of the stop piston 13. As a result, the stop piston 13 will find a stable operating position around this position of the second end portion 33.2 of the connecting channel 33.

As in the first embodiment of the invention, the second control chamber 25 is freely supplied by the low pressure accumulator 26, and will allow the stop piston 13 to be pushed forward and at high speed, for example when the rock gives way under the impact of the striking piston 5. This allows to quickly return to a normal bearing force of the tool of the drilling bar on the rock, despite the movements due to the penetration of the drilling bar in the ground and the various vibrations of the body 3 of the perforator, while ensuring, thanks to the first and third control chambers 22, 31, an average position of the stop piston 13 which respects the provided striking stroke C of the striking piston 5.

According to the second embodiment of the invention, the stop piston 13 includes an annular flange 43, also called an annular shoulder, which includes the annular bearing surface 39 and the first annular control surface 28. Thus, the annular flange 43 advantageously delimits in part the first control chamber 22 and in part the third control chamber 31.

According to the second embodiment of the invention, the supply channel 23 is advantageously devoid of a calibrated orifice, or of any other specific throttling element.

Figure 4:
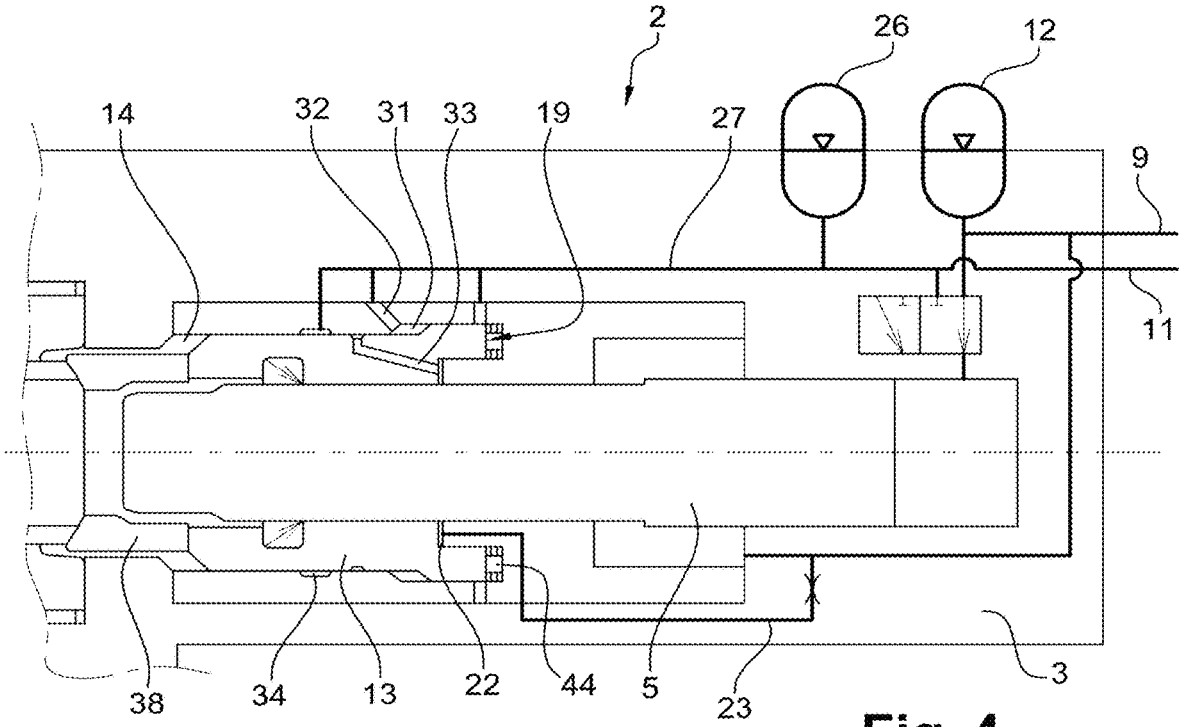
FIG. 4 is a longitudinal sectional view of a rotary percussive hydraulic perforator according to a third embodiment of the invention.

FIG. 4 represents a third embodiment of the rotary percussive hydraulic perforator 2 which differs from the first embodiment essentially in that the rotary percussive hydraulic perforator 2 includes a thrust bearing 44, such as a roller thrust bearing, disposed between the rear face 19 of the stop piston 13 and the rear wall 21 of the cavity 14.

When the striking system of the rotary percussive hydraulic perforator 2 is not supplied and the rotation system of the latter is in operation, the fitting 15 is in rotation as well as the stop member 38 and the stop piston 13. Since the positioning of the stop piston 13 in the predetermined equilibrium position is only done when the striking system is in operation (thus providing the necessary fluid in the first, second and third control chambers 22, 25, 31), then the stop piston 13 is pressed, by the reaction force of the ground, not against the rear wall 21 of the cavity 14 (which could induce rotary friction of the stop piston 13 against the body 3 and therefore generate damage to different constituent parts of the perforator), but against the thrust bearing 44 (which greatly limits the wear of the rotary percussive hydraulic perforator 2, and this without addition of outer fluid at the level of the stop piston 13).

It goes without saying that the invention is not limited to the only embodiments of this hydraulic perforator, described above by way of examples, on the contrary it encompasses all the variants thereof.

The invention claimed is:

1. A rotary percussive hydraulic perforator comprising:

a body, a fitting intended to be coupled to at least one drilling bar equipped with a tool, a striking piston slidably mounted inside the body along a striking axis and configured to strike the fitting, a stop piston which is slidably mounted in a cavity of the body along an axis of displacement substantially parallel to the striking axis, the stop piston including a front face facing the fitting and intended to position the fitting in a predetermined equilibrium position with respect to the striking piston, and a rear face opposite to the front face and situated opposite to a rear wall of the cavity, and a main hydraulic supply circuit configured to control an alternating sliding of the striking piston along the striking axis and to control a sliding of the stop piston along the axis of displacement, the main hydraulic supply circuit including a high pressure fluid supply conduit and a low pressure fluid return conduit, the body and the stop piston delimiting at least partially a first control chamber permanently connected to the high pressure fluid supply conduit and configured to bias the stop piston forwards, the rotary percussive hydraulic perforator further comprising a connecting channel configured to fluidly connect the first control chamber to the low pressure fluid return conduit when the rear face of the stop piston is located at a distance from the rear wall of the cavity which is greater than a predetermined value, wherein the main hydraulic supply circuit further includes a low pressure accumulator connected to the low pressure fluid return conduit, and in that the body and the stop piston further delimit at least partially a second control chamber permanently connected to the low pressure accumulator and configured to bias the stop piston forwards.

2. The rotary percussive hydraulic perforator according to claim 1, wherein the stop piston includes a first annular control surface extending transversely to the axis of displacement and delimiting at least partially the first control chamber and a second annular control surface extending transversely to the axis of displacement and at least partially delimiting the second control chamber, the second annular control surface having a surface area greater than the surface area of the first annular control surface.

3. The rotary percussive hydraulic perforator according to claim 2, wherein the body and the stop piston at least partially further delimit a third control chamber connected permanently to the low pressure fluid return conduit, the third control chamber being antagonistic to the first and second control chambers.

4. The rotary percussive hydraulic perforator according to claim 1, wherein the body and the stop piston at least partially further delimit a third control chamber connected permanently to the low pressure fluid return conduit, the third control chamber being antagonistic to the first and second control chambers.

5. The rotary percussive hydraulic perforator according to claim 4, wherein the third control chamber is connected to the low pressure fluid return conduit by a fluid communication channel provided with a calibrated orifice.

6. The rotary percussive hydraulic perforator according to claim 4, wherein the stop piston includes the connecting channel, and the connecting channel includes a first end portion opening into the third control chamber and a second end portion opposite to the first end portion and opening into an external surface of the stop piston, the second end portion of the connecting channel being able to be fluidly connected to the first control chamber when the rear face of the stop piston is located at a distance from the rear wall of the cavity which is greater than the predetermined value.

7. The rotary percussive hydraulic perforator according to claim 4, wherein the third control chamber is connected to the low pressure fluid return conduit by a fluid communication channel provided with a calibrated orifice.

8. The rotary percussive hydraulic perforator according to claim 7, wherein the stop piston includes the connecting channel, and the connecting channel includes a first end portion opening into the third control chamber and a second end portion opposite to the first end portion and opening into an external surface of the stop piston, the second end portion of the connecting channel being able to be fluidly connected to the first control chamber when the rear face of the stop piston is located at a distance from the rear wall of the cavity which is greater than the predetermined value.

9. The rotary percussive hydraulic perforator according to claim 8, wherein the stop piston includes the connecting channel.

10. The rotary percussive hydraulic perforator according to claim 9, wherein the connecting channel includes a first end portion opening into the first control chamber and a second end portion opposite to the first end portion and opening into an external surface of the stop piston, the second end portion of the connecting channel being able to be fluidly connected to the low pressure fluid return conduit when the rear face of the stop piston is located at a distance from the rear wall of the cavity which is greater than the predetermined value.

11. The rotary percussive hydraulic perforator according to claim 1, wherein the stop piston includes the connecting channel.

12. The rotary percussive hydraulic perforator according to claim 11, wherein the connecting channel includes a first end portion opening into the first control chamber and a second end portion opposite to the first end portion and opening into an external surface of the stop piston, the second end portion of the connecting channel being able to be fluidly connected to the low pressure fluid return conduit when the rear face of the stop piston is located at a distance from the rear wall of the cavity which is greater than the predetermined value.

13. The rotary percussive hydraulic perforator according to claim 12, wherein the body has an annular groove opening into the cavity and permanently connected to the low pressure fluid return conduit, the second end portion of the connecting channel being able to be fluidly connected to the annular groove when the rear face of the stop piston is located at a distance from the rear wall of the cavity which is greater than the predetermined value.

14. The rotary percussive hydraulic perforator according to claim 1, which includes a supply channel connecting the first control chamber to the high pressure fluid supply conduit.

15. The rotary percussive hydraulic perforator according to claim 14, wherein the supply channel is provided with a calibrated orifice.

16. The rotary percussive hydraulic perforator according to claim 1, wherein the stop piston is slidably mounted around the striking piston.

17. The rotary percussive hydraulic perforator according to claim 1, wherein the main hydraulic supply circuit includes a high pressure accumulator connected to the high pressure fluid supply conduit.

18. The rotary percussive hydraulic perforator according to claim 1, which further includes an annular stop member disposed between the fitting and the front face of the stop piston.

19. The rotary percussive hydraulic perforator according to claim 1, which includes a thrust bearing disposed between the rear face of the stop piston and the rear wall of the cavity.

20. The rotary percussive hydraulic perforator according to claim 1, wherein the stop piston includes an annular bearing surface configured to abut against an annular stop surface of the body.

* * * * *